US005689972A

United States Patent [19]

Schuster et al.

[11] Patent Number: 5,689,972

[45] Date of Patent: Nov. 25, 1997

[54] REFRIGERANT EXPANSION DEVICE

[75] Inventors: Don A. Schuster, Martinsville; Jeffrey L. Jones, Beech Grove; Loren D. Hoffman; Jeffery A. Storie, both of Indianapolis, all of Ind.

[73] Assignee: Carrier Corporation, Syracuse, N.Y.

[21] Appl. No.: 755,618

[22] Filed: Nov. 25, 1996

[51] Int. Cl.[6] ..... F25B 41/06

[52] U.S. Cl. ..... 62/511; 62/527; 137/513.3

[58] Field of Search ..... 62/511, 527, 528; 137/513.3

[56] References Cited

U.S. PATENT DOCUMENTS 3,659,433 5/1972 Shaw ..... 62/511

3,877,248 4/1975 Honnold, Jr. ..... 62/511

3,992,898 11/1976 Duell et al. ..... 62/324

5,186,021 2/1993 Keller ..... 62/511

*Primary Examiner*—Ronald C. Capossela

[57] ABSTRACT

To prevent refrigerant leakage when operating in a metering mode, a refrigerant expansion device, designed to selectively operate in either the meteting or bypass mode of operation, has a cylindrical ring installed to tightly hold the meteting piston in its metering position so as to prevent leakage ofrefrigerant therearound.

9 Claims, 2 Drawing Sheets

REFRIGERANT EXPANSION DEVICE

BACKGROUND OF THE INVENTION

This invention relates generally to air conditioning systems and, more specifically, to an improved device for reliably expanding the liquid refrigerant to a vapor.

In a conventional air conditioning system which includes a compressor, a condenser, an expansion device, and an evaporator connected in a closed circuit arrangement, the expansion device functions to change the liquid refrigerant flowing from the condenser to a gas flowing into the evaporator. Ideally, the expansion device should meter the refrigerant flowing to the evaporator in such a way that the refrigerant leaving the evaporator is superheated by a controlled, relatively small amount, thereby preventing the flow of liquid refrigerant into the compressor which could cause damage thereto. Since the degree of expansion is dependent on ambient conditions, the precise amount of desired superheat is not always maintained and, in fact, small amounts of liquid refrigerant commonly flow to the compressor. However, it is desirable to limit the amount of such liquid refrigerant flowing to the compressor.

Common types of refrigerant expansion devices include a simple capillary tube and the more complex thermostatic expansion valve (TXV). While the capillary tube is economical and simple, it is difficult to adapt to varying operating conditions. The TXV, on the other hand, is very effective, because it meters refrigerant in direct response to the refrigerant vapor temperature in the evaporator, but it is relatively expensive. For these reasons, an early form of an expansion device, which has become known as the "accurator", was developed by the assignee of the present invention. That device is described in U.S. Pat. No. 3,642,030, entitled *Refrigerant Throttling Device*, and issued on Feb. 15, 1972 in the name Larry D. Amick. That device was then improved on by a design described in U.S. Pat. No. 3,877,248, issued on Apr. 15, 1975 in the name of Fred V. Honnold, Jr.

The use of the above described types of refrigerant expansion devices could be used not only with air conditioning systems but also with heat pumps, wherein the direction ofrefrigerant flow was reversed. However, because of the need for different expansion requirements for cooling and heating, a single device could not be used for both operations. Instead, it was necessary to provide a separate device for each mode, while also providing a bypass around the other (unused) refrigerant expansion device. In order to eliminate the need for a separate bypass tube around each device, an improved form of the "accurator" was developed as described in U.S. Pat. No. 3,992,898, issued on Nov. 23, 1976, in the name of Richard Duell et al. Here, a free floating piston was provided in the "accurator" body such that when the refrigerant was flowing in one direction the piston acted to meter the flow, whereas when it was flowing in the other direction the piston bypassed the refrigerant without being metered. In this way, not only was the need for a separate bypass circuit eliminated, but it also provided the ability to easily change the degree of expansion by simply changing the piston. Also, the same device could be used for either heat pump or air conditioning applications.

It was recently recognized that when the above described, bypass type of "aceurator", was used in an air conditioning application, the amount of superheat certain ambient conditions may be substantially reduced thereby causing excessive liquid refrigerant flow to the compressor. It was determined that this is often caused by improper seating between the piston and the piston body. That is, at certain operating conditions, such as at relatively low ambient temperatures when the pressure differential is reduced, the piston was not satisfactorily engaging the piston body such that there was leakage of refrigerant therebetween. This condition was exacerbated by other mechanical conditions that could occur, such as debris becoming lodged between the two parts or improper machining of one of the parts to create an imperfection.

It is therefore an object of the present invention to provide an improved refrigerant expansion device.

Another object of the present invention is the provision for obtaining better expansion performance at low ambient conditions.

Yet another object of the present invention is the provision for accommodating small amounts of debris in the refrigerant flow.

Still another object of the present invention is the provision for accommodating poorly machined parts in a refrigerant expansion device.

These objects and other features and advantages become more readily apparent upon reference to the following descriptions when taken in conjunction with the appended drawings.

SUMMARY OF THE INVENTION

Briefly, in accordance with one aspect of the invention, a PRIOR ART refrigerant expansion device which was designed to operate in either of the metering or bypass modes, is modified so as to effectively eliminate the bypass mode, but in such a way as to ensure that when operating in the metering mode, leakage around the metering element is minimized. This is accomplished by the installation of a cylindrical ring into that space into which the metering piston was intended to move when operating in the bypass mode, such that the ring maintains the piston in its metering position so as to prevent leakage of refrigerant around its edges.

In the drawings as hereinafter described, a preferred embodiment is depicted; however, various other modifications and alternate construction can be made thereto without departing from the true spirit and scope of the invention.

DESCRIPTION OF THE PREFERRED EMBODIMENTS

Figure 1:
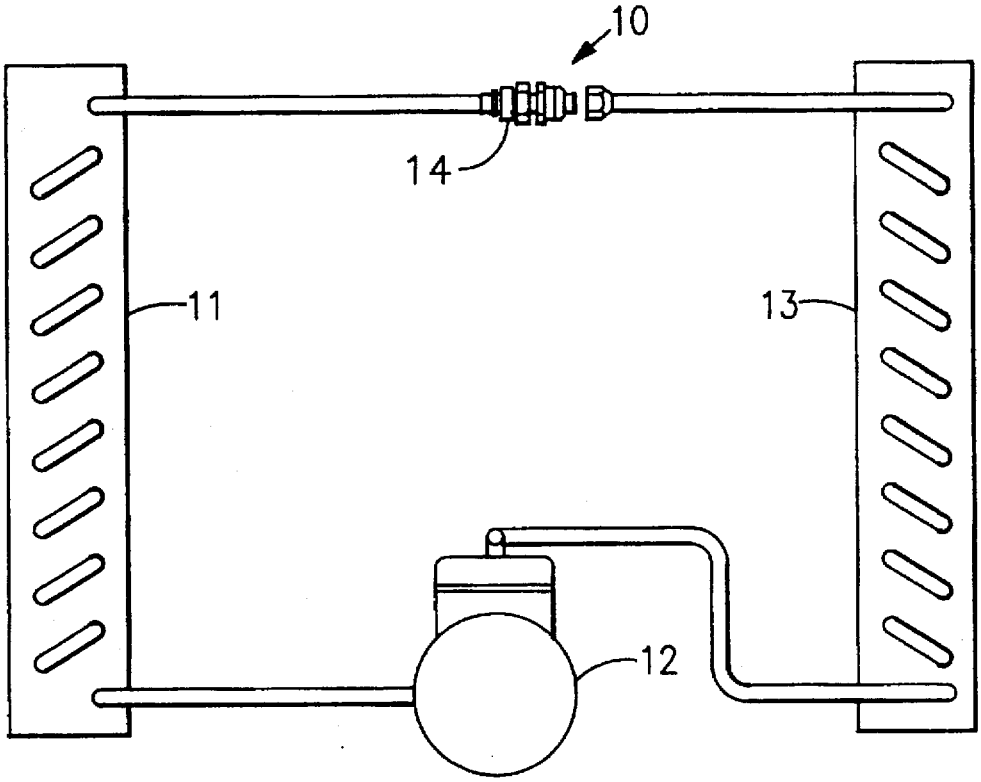
FIG. 1 is a schematic illustration of an air conditioning system into which the refrigerant expansion device of the present invention is installed.

Referring now to FIG. 1, the invention is shown generally at 10 as being incorporated into an air conditioning system having an evaporator coil 11, a compressor 12, a condenser coil 13 and a refrigerant expansion device 14. The refrigerant expansion device 14 is of the type which is normally used for either air conditioning or heat pump applications, but is modified in accordance with the present invention to function only in the air conditioning mode, but in an improved manner.

In the qualification of an air conditioning system, it is common to undergo a so-called "flood back test" wherein the system is run at a relatively low ambient condition (i.e. 67° F.) and reduced air flow (i.e. 200 CFM per ton). Under these conditions, the pressure drop across the refrigerant expansion device 14 is reduced and, if the refrigerant expansion device 14 is not operating properly, may cause flooding of the evaporator and compressor. The present invention is intended to prevent this problem.

Figure 2:
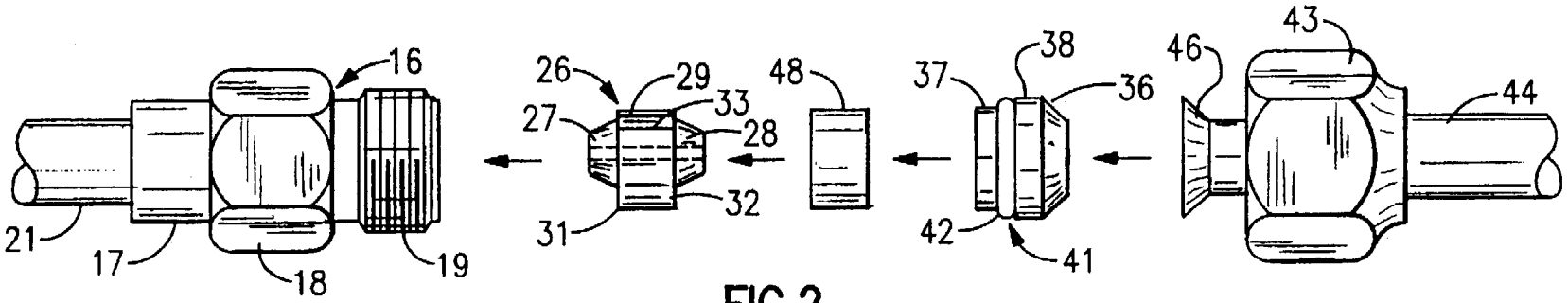
FIG. 2 is an exploded view of a refrigerant expansion device of the present invention.
Figure 3:
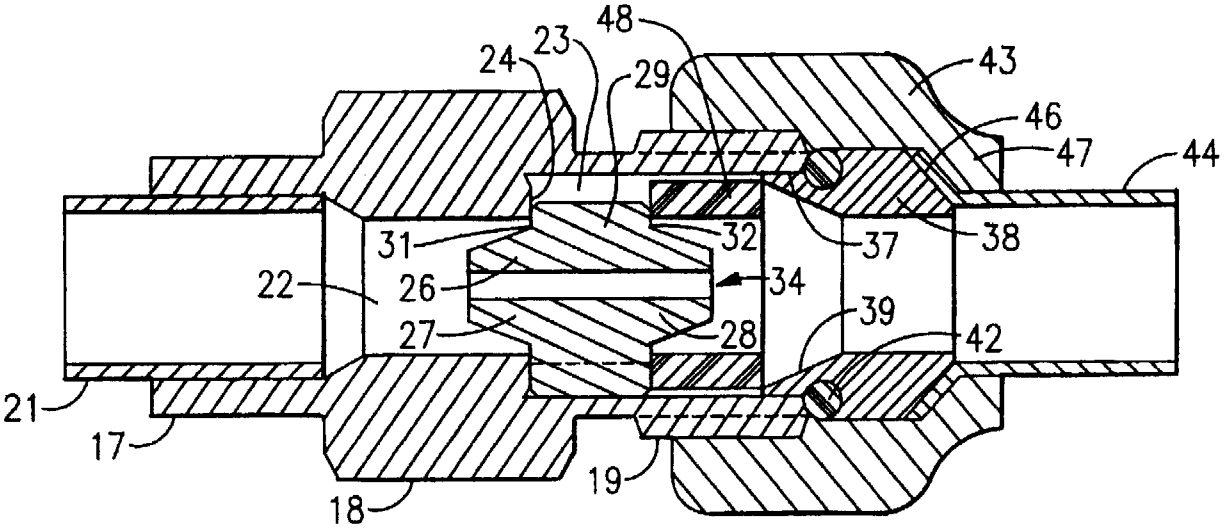
FIG. 3 is an axial cross sectional view of the refrigerant expansion device of the present invention.

Referring now to FIGS. 2 and 3, the refrigerant expansion device 14 is shown in exploded and assembled views, respectively. A piston body 16 is integrally formed of a cylindrical discharge section 17, a hexagonal section 18, and a threaded section 19. The discharge section 17 is adapted to receive in its internal diameter a tube 21 which is connected directly to the evaporator 11. Formed on the inside of the piston body 16 is a small cylindrical cavity 22 and a large cylindrical cavity 23, with a radially extending annular shoulder 24 therebetween. The small cavity 22 is where liquid refrigerant is changed to a vapor as it flows from the orifice as will be described hereinafter. The large cavity 23 is sized and designed to receive a piston 26 therein and, as originally designed, allowed axial movement of the piston 26 so as to permit selective refrigerant metering in one flow direction and bypass of refrigerant in the other.

The piston 26 has first and second frustoconical ends 27 and 28 with a central cylindrical portion 29 therebetween. At the ends of the central portion 29 are first and second shoulders 31 and 32. Integrally formed on the central portion 29 are a plurality of axially extending, circumferentially spaced flutes 33, whose purpose are to provide flow passages for bypass flow when that mode of operation is desired. The piston 26 has a central bore or orifice 34 whose diameter is chosen so as to meter a specific amount ofrefrigerant that is required for the particular system in which it is installed.

A piston retainer 36 is formed of integrally connected small and large portions 37 and 38, respectively. The small portion 37 has an outer diameter that is slightly smaller than the internal diameter of the threaded section 19 of the piston body 16, such that the small portion 37 can be slideably received into the threaded section 19 in a close fit relationship. The small portion 37 has a beveled surface 39 around its inner side to accommodate the desired engagement with the second shoulder 32 of the piston 26 in such a way as to bypass refrigerant when operating under certain conditions. The piston retainer large portion 38 has an internal diameter which defines the opening into which the liquid refrigerant flows. Its outer diameter is greater than that of the small section 37, and between the small portion 37 and large portion 38, on the outer sides thereof, there is an annular groove 41 into which an o-ring 42 is disposed. The internally beveled surface of liquid line 44 seals to the externally beveled surface of 36 of retainer 38 by a metal-to-metal seal. The hexagonal fastener 43 is slideably disposed over the liquid line 44 and has internal threads that are screwed on to the threaded section 19 to secure the assembly of components together. The liquid line 44 has a flared end 46 which fits tightly between the trailing portion 47 of the hexagonal fastener 43 and the piston retainer large portion 38, as shown.

The assembly of components as so far described is in accordance with the PRIOR ART and is intended to operate as follows. When the refrigerant flow is in the direction as shown by the arrows, the piston 26 is moved to the left such that its first shoulder 31 engages the shoulder 24 of the piston body 16. In this position, the flutes 33 are radially outside the inner diameter of the cavity 22, such that the shoulder 24 prevents the refrigerant from flowing through the flutes and into the cavity 22. Accordingly, the only flow is through the orifice 34 which acts to precisely measure the flow in accordance with a predetermined flow volume.

When the device is now used in a heat pump mode, the refrigerant is made to flow in the opposite direction, and a similar device placed near the inlet of the outdoor coil is used for the metering function. It is thus necessary to allow the refrigerant to bypass the metering device in the present assembly. This is accomplished by allowing the piston 26 to slide to the right within the large cavity 23 such that its second shoulder 32 engages the beveled surface 39 of the piston retainer 36. In this position, it is only the corners of the second shoulder 32 that engage the beveled surface 39, so that the refrigerant can easily pass through the flutes 33 and around the piston 36 to thereby permit a relatively unrestricted flow of refrigerant to the right.

Consider now the use of the present assembly as described above in an air conditioning mode only. That is, having an expansion device which can serve for either metering or bypassing, it is desirable to use the same apparatus for use in systems wherein only the air conditioning mode is used, with the bypass function being eliminated. It is this mode for which the present invention is intended. Thus, the apparatus as described hereinabove would be used only with the refrigerant being in the flow direction shown, with the piston 26 always being in the left portion of the cavity 23 and engaging the shoulder 24. Under most such operating conditions, the apparatus as described above will perform satisfactorily. However, under some conditions, such as at low ambient temperature conditions, the pressure drop may not be sufficient to fully seat the piston first shoulder 31 tightly against the shoulder 24 of the piston body. This conditioning may also be exacerbated by imperfections that may be found in those surfaces because of machining errors or because of the entry of debris into the space between those surfaces. The present invention was designed to overcome these problems.

Figure 4:
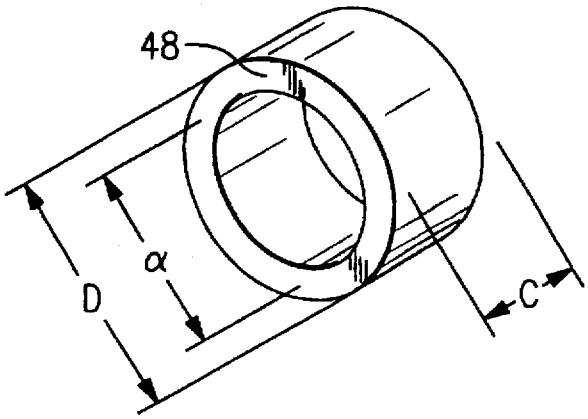
FIG. 4 is a perspective view of the piston ring portion of the refrigerant expansion device of the present invention.

Referring again to FIGS. 2 and 3, a piston ring 48 is shown as installed in the large cavity 23 between the piston 26 and the piston retainer 36. piston ring 48 may take any of various forms and be composed of any of various materials; however, the preferred embodiment is a simply a cylinder as shown in FIGS. 2, 3 and 4, which is composed of a neoprene material. The internal diameter, d, the outer diameter, "D", and the length, "L", are all selected such that the piston ring fits around the second frustoconical end 28 of the piston 26, loosely fits within the cavity 26, and has its ends engage the piston second shoulder 32 and the retainer beveled surface 39, respectively, in such a way as to positively position the piston 26 to the left so that the piston first shoulder 31 firmly engages the body shoulder 24 when the hexagonal fastener 43 is tightened to move the piston retainer 36 into its installed position. In this way, the piston 26 is held in that position to minimize the leakage which might otherwise occur between the two shoulders 31 and 24.

Although this invention has been shown and described with respect to a preferred embodiment, it will be understood to those skilled in the art that various changes in the form and detail may be made without departing from the true spirit and scope of the claimed invention.

What is claimed is:

1. A refrigerant expansion device for use in a refrigeration system having an evaporator coil, a compressor and a condenser coil in serial flow relationship, comprising:

a body with a first internal bore fluidly interconnecting a discharge tube at its one end with a second internal bore near its other end;

said body having an annular shoulder extending generall radially outwardly from said first intenal bore to said second internal bore;

a piston disposed in said second bore and having a metering orifice for controlling the flow of refrigerant therethrough and into said body first bore;

said piston having a generally radially extending shoulder for axially engaging said body shoulder;

a retainer secured in said second body other end and having a bore for conducting the flow of refrigerant therethrough; and a ring disposed between said retainer and said piston, said ring having end surfaces engaging corresponding end surfaces of said piston and retainer such that said piston shoulder is held tightly against said body shoulder to minimize leakage of refrigerant therebetween.

2. A refigerant expansion device as set forth in claim 1 wherein said ring is cylindrical in shape.

3. A refrigerant expansion device as set forth in claim 1 wherein said ring is composed of a neoprene material.

4. An improved refrigerant expansion device of the type having:

a body with a first bore and a second bore defining a shoulder therebetween;

a retainer secured to said body near said second bore;

and a piston slideably disposed within said second bore and having a central bore for metering refrigerant when disposed in one extreme position with its one end engaging said shoulder, and to bypass refrigerant in the other extreme position wherein the refrigerant flow is in the other direction and the piston other end is engaging said retainer;

wherein the improvement comprising;

a ring disposed between said piston and said retainer so as to not only prevent said piston from sliding to said other extreme position but to also urge said piston one end against said shoulder to minimize leakage of refrigerant therebetween.

5. An improved refrigerant expansion device as set forth in claim 4 wherein said ring comprises a cylinder.

6. An improved refrigerant expansion device as set forth in claim 4 wherein said ring is comprised of a neoprene material.

7. An improved refrigerant expansion device of the type having a piston axially disposed between a shoulder of a piston body and a retainer shoulder;

said piston having an orifice for metering refrigerant and having first and second shoulders being axially spaced a predetermined distance, which distance is less than a distance that the piston body shoulder and retainer shoulder are spaced;

said piston body shoulder being sized such that when the refrigerant flow is in one direction the piston first shoulder engages said piston body shoulder to restrict the flow of refrigerant therebetween and cause the refrigerant to flow through the orifice;

wherein the improvement comprises:

a ring disposed between said piston second shoulder and said piston retainer, said ring having an axial length substantially equal to said predetermined distance such that said piston first shoulder is held tightly against said piston body shoulder to prevent leakage therebetween.

8. An improved refrigerant expansion device as set forth in claim 7 wherein said ring is cylindrical in form.

9. An improved refrigerant expansion device as set forth in claim 7 wherein said ring is composed of a neoprene material.

* * * * *